US005355852A

United States Patent [19]

Smith et al.

[11] Patent Number: 5,355,852

[45] Date of Patent: Oct. 18, 1994

[54] METHOD TO LIMIT SMOKE AND FIRE WHEN LOADING A DIESEL ENGINE

[75] Inventors: Myron L. Smith, Fairview, Pa.; David J. Konko, Dunkirk, N.Y.; Richard L. Evans, Jr., North East; Harold S. Hostettler, Jr., Edinboro, both of Pa.

[73] Assignee: General Electric Company, Erie, Pa.

[21] Appl. No.: 85,655

[22] Filed: Jul. 1, 1993

[51] Int. Cl.[5] ..... F02D 1/00

[52] U.S. Cl. ..... 123/350

[58] Field of Search ..... 123/350, 478, 480; 60/329; 364/431.07

[56] References Cited

U.S. PATENT DOCUMENTS 3,809,038 5/1974 Young ..... 123/350
3,859,541 1/1975 Hattori et al. ..... 123/350
4,232,647 11/1980 Van Siclen, Jr. ..... 123/478
5,079,710 1/1992 Brauninger et al. ..... 364/431.07
5,251,440 10/1993 Bong-Dong et al. ..... 60/329

*Primary Examiner*—Raymond A. Nelli
*Attorney, Agent, or Firm*—Jill M. Breedlove; Marvin Snyder

[57] ABSTRACT

A method for limiting smoke and fire upon loading a diesel engine having a power piston with a variable piston gap for controlling fueling of the engine, includes sensing the piston gap value on a cyclical basis, computing the piston gap velocity, comparing the computed piston gap velocity with a preset piston gap velocity range, and adjusting engine horsepower output upon the computation of an abnormal piston gap velocity reading. Thus, engine overfueling during loading is prevented.

17 Claims, 5 Drawing Sheets

METHOD TO LIMIT SMOKE AND FIRE WHEN LOADING A DIESEL ENGINE

BACKGROUND OF THE INVENTION

The present invention relates generally to control systems for diesel engines, and particularly to a system for regulating the loading of a diesel locomotive.

Conventional diesel engines, including, but not limited to those used in locomotives, are often provided with a range of preset throttle speeds available for selection by the operator. In the case of locomotives, to accelerate, the operator progresses sequentially through the range of preset throttle speeds. Acting in concert with the throttle adjustment is an engine loading system which is normally under computer control. Engine loading relates to the amount of fuel/air mixture which is sent to the engine to achieve a certain throttle speed. In one type of conventional diesel engine control system, a governor employing a power piston is used to regulate engine loading. The power piston controls the amount of fuel being distributed to the cylinders.

It has been found that when locomotives having the above-identified engine control system are employed at sea level, the engine loading function of the power piston operates satisfactorily. However, when such locomotives are operated at higher altitudes, the relatively thinner air causes the engine loading system to provide an excessively rich fuel/air mixture. An excessively rich mixture can also occur when the engine is not in proper tune. An undesirable and possibly hazardous side effect of the rich mixture is that the engine may emit transient smoke or fire.

Prior attempts to eliminate transient smoke or fire incorporate either analog or digital engine control systems which control engine loading by determining the amount of air available for combustion, and applying that value to sensed or computed values for engine speed, the amount of fuel being provided for combustion, and current engine loading. This operation results in an approximation of how much additional electrical load can be added. In instances where the engine begins to "bog", such systems have a function for removing some of the electrical load. It is also known to provide a "fuel limiter" to constrain the maximum amount of fuel that can be provided to the engine at any given time. It has been found that these prior attempts are less than totally satisfactory for reliable locomotive engine performance at a variety of elevations and under a wide range of environmental conditions.

Accordingly, a main object of the present invention is to provide a control system for a diesel engine which automatically adjusts engine loading in response to environmental conditions.

Another object of the present invention is to provide a control system for a diesel engine which senses conditions causing engine overloading, and automatically reduces loading a corresponding amount to avoid unwanted conditions such as transient smoke and fire.

SUMMARY OF THE INVENTION

The above-identified objects are met and/or exceeded by the present method for limiting smoke and fire upon loading diesel engines having a power piston with a variable piston gap for controlling fueling of the engine. A computerized feedback routine monitors the displacement of the power piston as a measure of engine loading, calculates the piston gap value over time, i.e.

the power piston velocity, and compares the computed velocity with a preset velocity range, while taking into account environmental and engine performance factors such as throttle setting, ambient temperature and barometric pressure.

More specifically, the present method includes the steps of sensing the piston gap value on a cyclical basis, computing the power piston gap velocity, comparing the computed piston gap velocity with a preset piston gap velocity range, and adjusting engine horsepower output upon the computing of an abnormal piston gap velocity reading. In the preferred embodiment, the engine horsepower load rate is reduced a preset amount upon the computing of an abnormal power piston velocity.

In situations where the power piston gap velocity is computed to be within the preset range, the rate of change of engine horsepower is determined and the power piston velocity is monitored. Where the total engine horsepower is below a preset minimum, and the engine is neither in an operating nor a self-test mode, the power piston velocity range is disregarded. In all other situations, if the power piston velocity exceeds the preset level, the change of horsepower is significantly reduced. In the preferred embodiment, the horsepower is reduced by a factor of four.

Thus, engine overfueling during loading is prevented. A resulting benefit of reduced overfueling is a significant reduction in transient smoke and/or fire emissions by locomotives equipped with software embodying the present method.

DESCRIPTION OF THE PREFERRED EMBODIMENT

Figure 1:
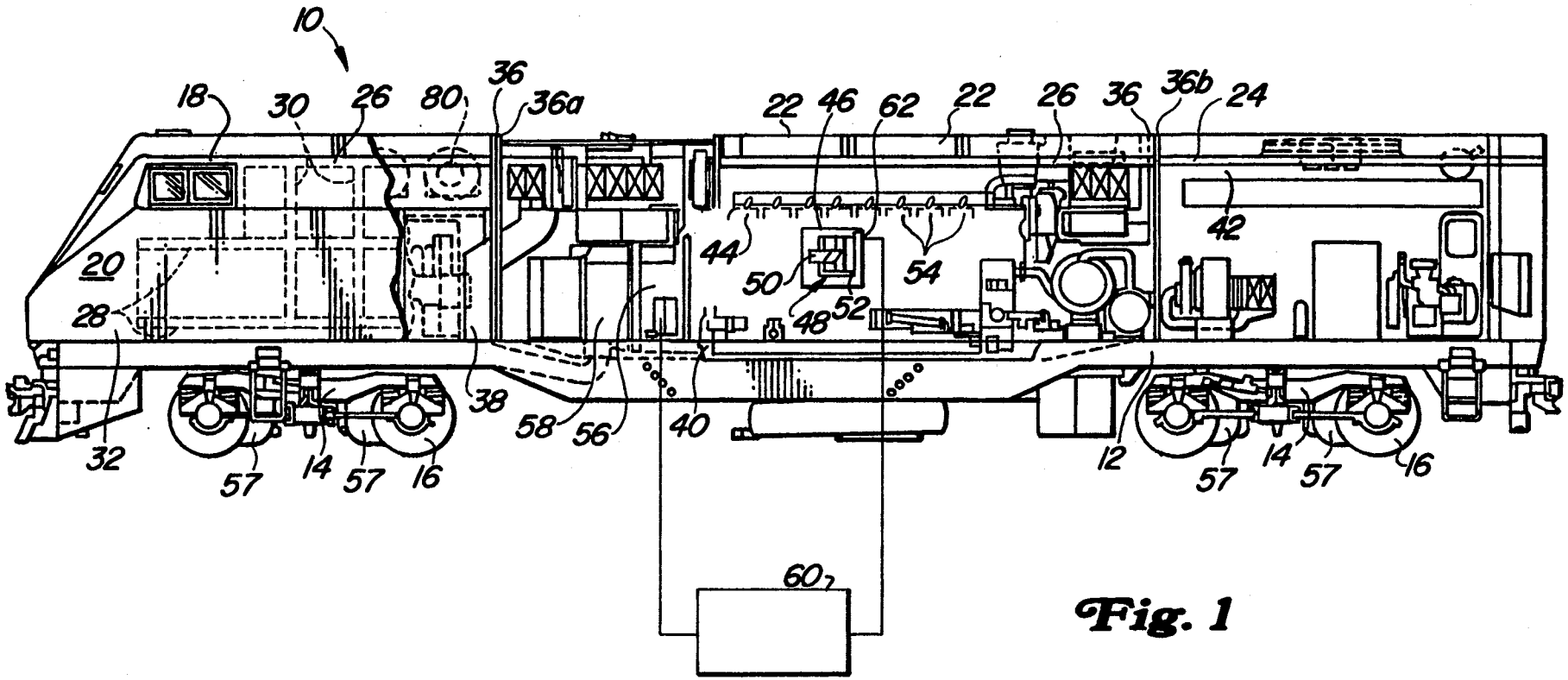
FIG. 1 is a side elevational view of a locomotive of the type suitable for use with the present method, with portions either eliminated or shown broken away for clarity.

Referring now to FIG. 1, a locomotive of the type suitable for use with the present method is generally designated 10. The locomotive 10 is of a type generally referred to as a monocoque locomotive, and has a horizonal, generally flat platform 12. A pair of trucks 14, each having a set of rotatably mounted railroad wheels 16 are mounted to an underside of the platform 12. The platform 12 forms a lower portion of carbody 18, which includes a pair of sidewalls 20 (only one shown fragmentarily) extending along the sides of the platform, as well as a plurality of roof hatches 22 disposed transversely across the carbody from sidewall 20 to sidewall.
e Due to the monocoque construction of the locomotive 10, structural support is provided to the carbody 18 by an inner frame 24 represented in part by a cant rail 26. The cant rail 26 is one of a number of horizontal supports 28 (partially shown hidden) attached to vertical supports 30 (partially shown hidden) which form the frame 24 for the carbody 18. Attached to the exterior of the frame 24 is a plurality of thin metal sheets 32 which form the exterior surface of the carbody 18.

The carbody 18 also includes a series of bulkheads 36, each of which extend transversely across the platform 12 from sidewall 20 to sidewall. The bulkheads 36 are attached, preferably by welding, to the sidewalls 20 and platform 12 to separate the carbody 18 into crew compartment 38, engine compartment 40 and radiator compartment 42. Further, bulkheads 36 provide structural support to the carbody 18 principally by acting as a brace to the horizontal supports 28 in the sidewalls 20. The bulkheads 36 include a forward bulkhead **36*a* which separates the crew compartment 38 from the engine compartment 40, and a rear bulkhead 36*b* defining the radiator compartment 42 behind the engine compartment 40**.

Within the carbody 18 are many of the components needed to power and control the locomotive 10. Primary among these components is a diesel engine, generally designated and schematically indicated at 44, the construction and operation of which is well known to skilled practitioners. Included in operational relationship to the engine 44 is a governor schematically indicated at 46. The appearance and orientation of the schematic governor 46 are for the purposes of explanation only and are not intended to accurately reflect the placement, scaling and orientation of the actual governor on the engine 44. Governors are typically employed on diesel locomotives, and the preferred type employs a power piston 48, which includes a piston shaft 50 reciprocally movable relative to a cylinder 52 and thus regulates the amount of fuel/air mixture which is sent to the cylinders 54 (shown partially) of the engine 44. The preferred model of governor 46 is Type PG, Model 18572-525 manufactured by the Woodward Governor Company, Ft. Collins, Colo., although other suitable substitutes are contemplated.

Connected to the engine 44 is a traction alternator 56 which translates mechanical horsepower generated by the engine to electrical power for driving the wheels 16 through a set of traction motors 57. At least one auxiliary alternator 58 is connected to the engine driveshaft (not shown) to receive power from the engine 44 for operating the auxiliary functions of the locomotive 10 as is known in the art.

A control module 60 is shown schematically, and is provided for monitoring the displacement of the power piston 48, for computing the power piston gap velocity, and for controlling the horsepower output of the engine 44 accordingly. The module 60 includes a sensor 62 also shown schematically, which is electrically connected to the power piston 48 for monitoring the velocity of the piston, i.e., the amount of travel of the piston shaft 50 relative to the cylinder 52 over time. The sensor 62 is preferably a linear variable differential transformer (LVDT) sensor which is physically contained within the governor 46 and connected to the piston shaft 50 to translate into voltage the linear displacement of the piston shaft relative to the cylinder 52. Since the power piston 48 controls the amount of fuel injected into the cylinders 54, the velocity of the power piston is directly proportional to the amount of loading to which the engine 44 is subjected.

Figure 2:
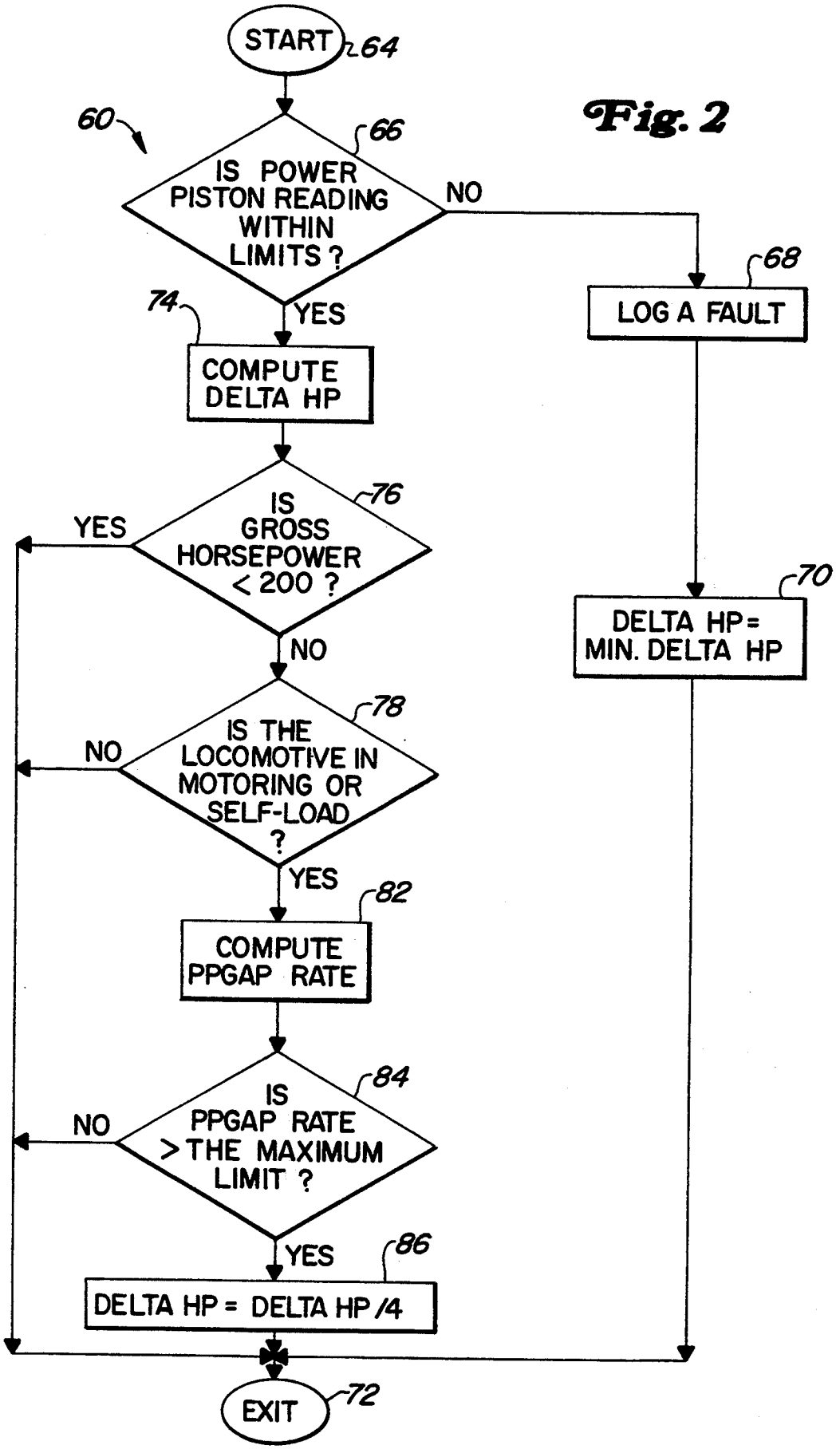
FIG. 2 is a flow chart representation of the present method.

Referring now to FIG. 2, a schematic flow chart of the operation of the control module 60 is illustrated. At the start block, designated 64, the module 60 begins a monitoring cycle, which, in the preferred embodiment, occurs once every 60 milliseconds. At decision block 66, the power piston gap or displacement is read. On subsequent cycles, the displacement is reread, and the change over time is computed and referred to as the power piston gap velocity. When the module 60 is initially programmed, a specified range of power piston gap values, as well as a preferred range of power piston gap velocities are provided. The programmed velocity range represents the maximum allowable travel rate of the power piston under the perceived operational conditions of the locomotive 10. In the preferred embodiment, the acceptable range of piston gap values is between approximately 0.304 and 1.214 inches, and the preferred range of velocity of the power piston is on the order of 0.008 to 0.252 inches per second.

At decision point 66, the sensed power piston gap value is compared with the acceptable ranges, in conjunction with diesel engine speed. If the engine speed is between 400 and 1100 rpm, and the sensed displacement is greater than 1.214 inches or less than 0.304 inches, a fault is logged, as shown at block 68. Sensed readings outside the range are normally indicative of a faulty sensing transducer. Thus, the control module 60 is designed to display a "sensor error" or equivalent warning.

Referring now to block 70, in order to maintain engine operation despite the presence of a faulty piston gap sensor, the control module 60 is designed to permit the engine to load, but at a reduced rate, designated MIN DELTA HP. At the MIN DELTA HP rate, engine loading will be adequate but not at optimum performance. Upon the programmed reduction in engine loading the cycle is completed, as designated by block 72, and repeats.

Referring again to block 66, should the piston gap sensing transducer be operating properly, the sensed piston gap displacement value is retained for subsequent use, and the module 60 progresses to block 74 at which the DELTA HP value is calculated. The DELTA HP value, which refers to the engine power to be added in the next 60 millisecond period, is obtained through a conventional locomotive engine loading subroutine, which may be either analog or digital. In an analog system, engine control is obtained through circuits for providing inputs of atmospheric and engine operational parameters. The circuits then control the application of electrical load on a prescribed load ramp.

In the preferred embodiment, the DELTA HP is obtained digitally. Basically, the values for the various desired inputs are obtained, either by sensors or calculation, and then a calculation is made of the amount of additional electrical load which can be applied in the next time sample. More specifically, the subroutine responds to a initial "call" for power, such as through operation of the throttle control, or in the present application, through a signal from the decision block 66. Next, the subroutine 74 uses monitored engine speed, followed by a calculation of engine intake manifold air pressure ("MAP"). Additional calculations are made for ambient conditions such as ambient barometric pressure and ambient temperature.

After the above calculations, additional data is obtained, specifically the current total engine load, the electrical load, and the engine acceleration loads, as well as the amount of fuel being provided to the engine 44. The latter class of information relates to considerations such as the fact that when the engine is cold, it will load more slowly, and cannot be subjected to full power. Upon evaluation of the above data, a decision is made as to whether the engine is loading properly, by checking the engine load control potentiometer (not shown). If the engine is determined to be loading improperly, the subroutine 74 computes the amount of horsepower to be removed from the engine. Alternately, if the engine is determined to be loading properly, the subroutine 74 computes the amount of additional horsepower to be applied.

The next step for the subroutine 74 is to apply slew limits to the traction power computations for proper control of the voltage to be applied over time to the traction motors through the corresponding alternator. In conventional subroutines, the system then generates a "call" for increased or decreased power from the traction alternator. After waiting a designated delta time value, the control loop is repeated. Conventional subroutines have proven to provide unpredictable results under varied environmental applications, such as when locomotives are used at high altitudes. However, in the present system, the control module 60 is programmed so that the DELTA HP subroutine 74 is employed in conjunction with the power piston gap value for controlling engine loading by determining how much horsepower will be added during the next cycle, for sensing when the engine is overloading, and for automatically reducing the loading to avoid overfueling.

The next step in the present method is indicated at decision point 76, where the engine horsepower is calculated and evaluated. If the gross horsepower generated by the engine 44 is less than 200, as shown at 74, the engine is considered to be in the warming up process or under light loading. Under such conditions, rapid changes in power piston velocity may be expected, with little expectation for resulting transient smoke and fire. Thus, such a reading triggers the control module 60 to return to the start block 64 via the exit point 72.

If alternately, the calculated horsepower reading is greater than 200 horsepower, the control module 60 determines whether the locomotive 10 is in the "motoring" or "self load" modes, as shown at step 78. "Motoring" refers to an operating condition whereby the locomotive traction alternator 56 is being used to provide power to the traction motors 57. "Self Load" refers to an operating condition whereby the locomotive traction alternator 56 is being used to provide power to the dynamic brake grids 80 (best seen in FIG. 1) in order to load test the diesel engine 44. Thus, this condition may be sensed electronically by a connection between the module 60 and the alternator 56.

If the locomotive 10 is neither motoring nor in the self loading mode, the control module 60 returns to the start block 64 through the exit point 72 and awaits the next 60 millisecond monitoring period. If the locomotive is either motoring or self loading, the module 60 calculates the power piston velocity in inches/second as shown at block 82.

Moving to decision point 84, if the power piston velocity is less than the maximum limit, i.e. it is acceptable for the specified loading conditions, the control module 60 returns to the start block 64 through the exit point 72 and awaits the next 60 millisecond monitoring period. On the other hand, and referring to block 86, if the power piston velocity is greater than the maximum limit, engine horsepower is significantly reduced by reducing DELTA HP to 25% of its calculated value. It is contemplated that other magnitudes of automatic horsepower reduction may be employed, as dictated by the particular application. Reduced engine loading will cause a corresponding decrease in the velocity of the power piston 48, which reduces the fueling of the engine 44. Upon the reduction of horsepower described above, the engine 44 will be automatically prevented from overfueling at an earlier stage in the operational cycle than was possible using prior locomotive engine control technology.

Figure 3:
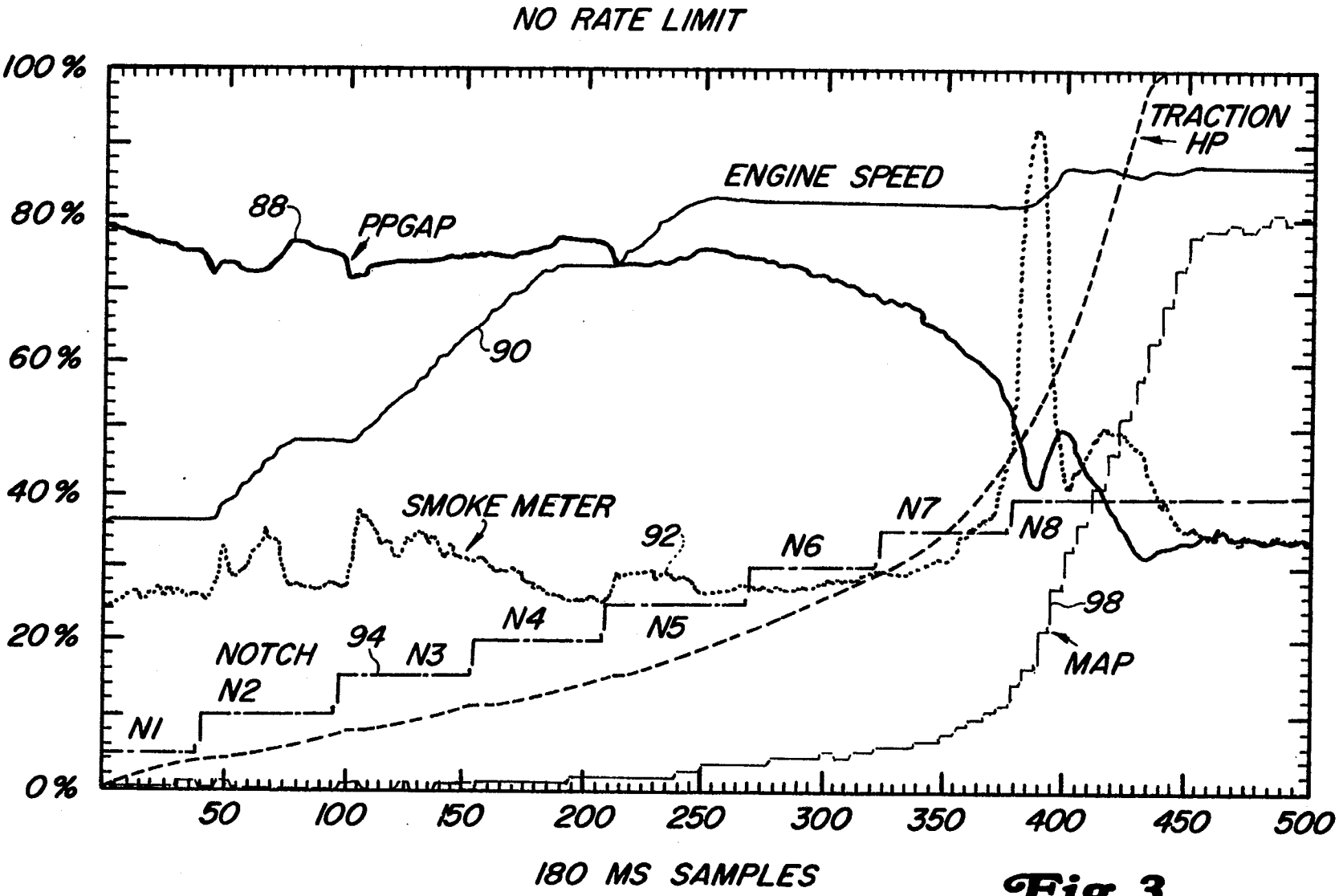
FIG. 3 is a graphic representation of test results of a locomotive in a control mode, i.e., not employing the present method.
Figure 4:
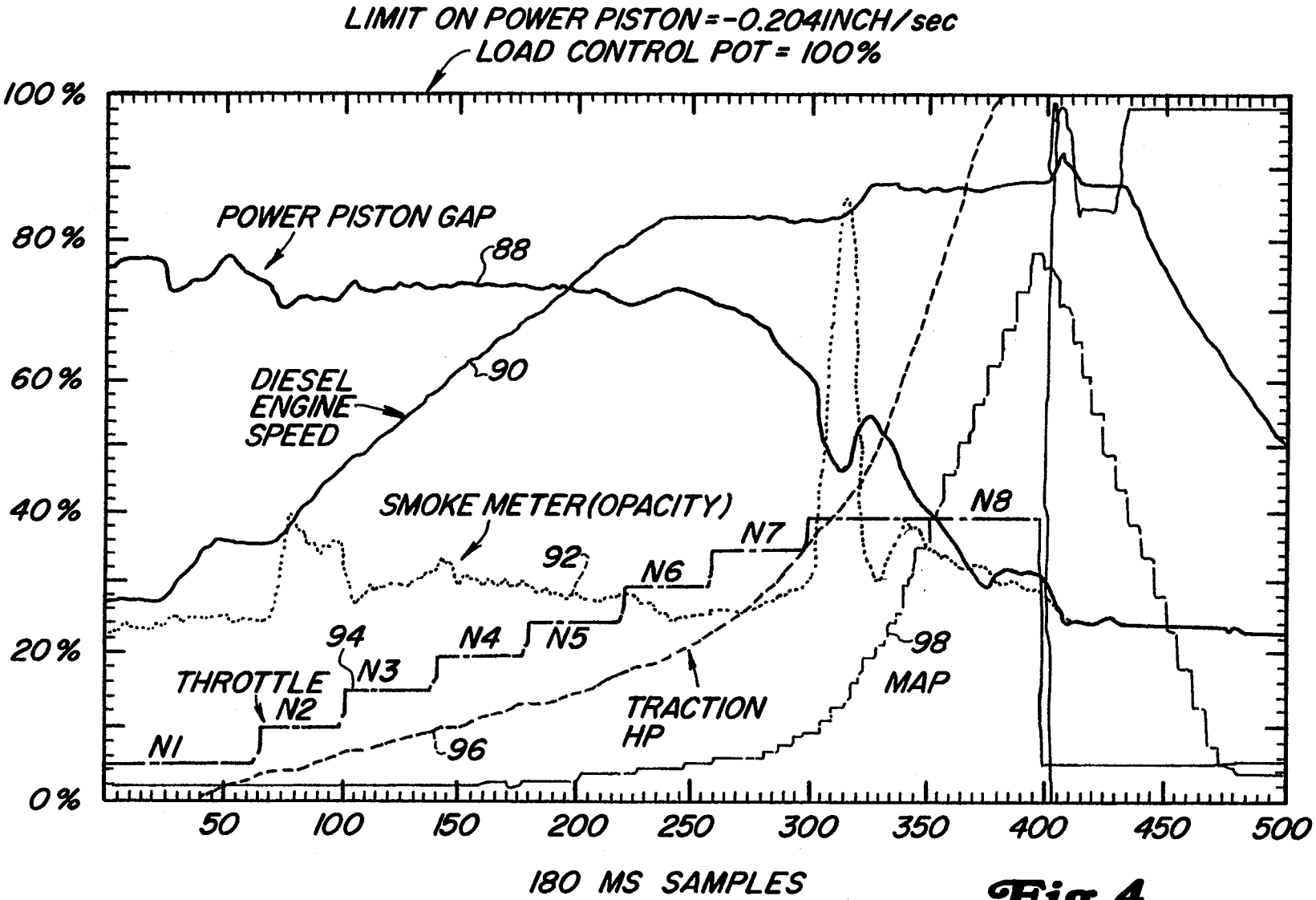
FIG. 4 is a graphic representation of test results of a locomotive employing the present method wherein the power piston gap velocity was limited to 0.204 inches/-second.
Figure 5:
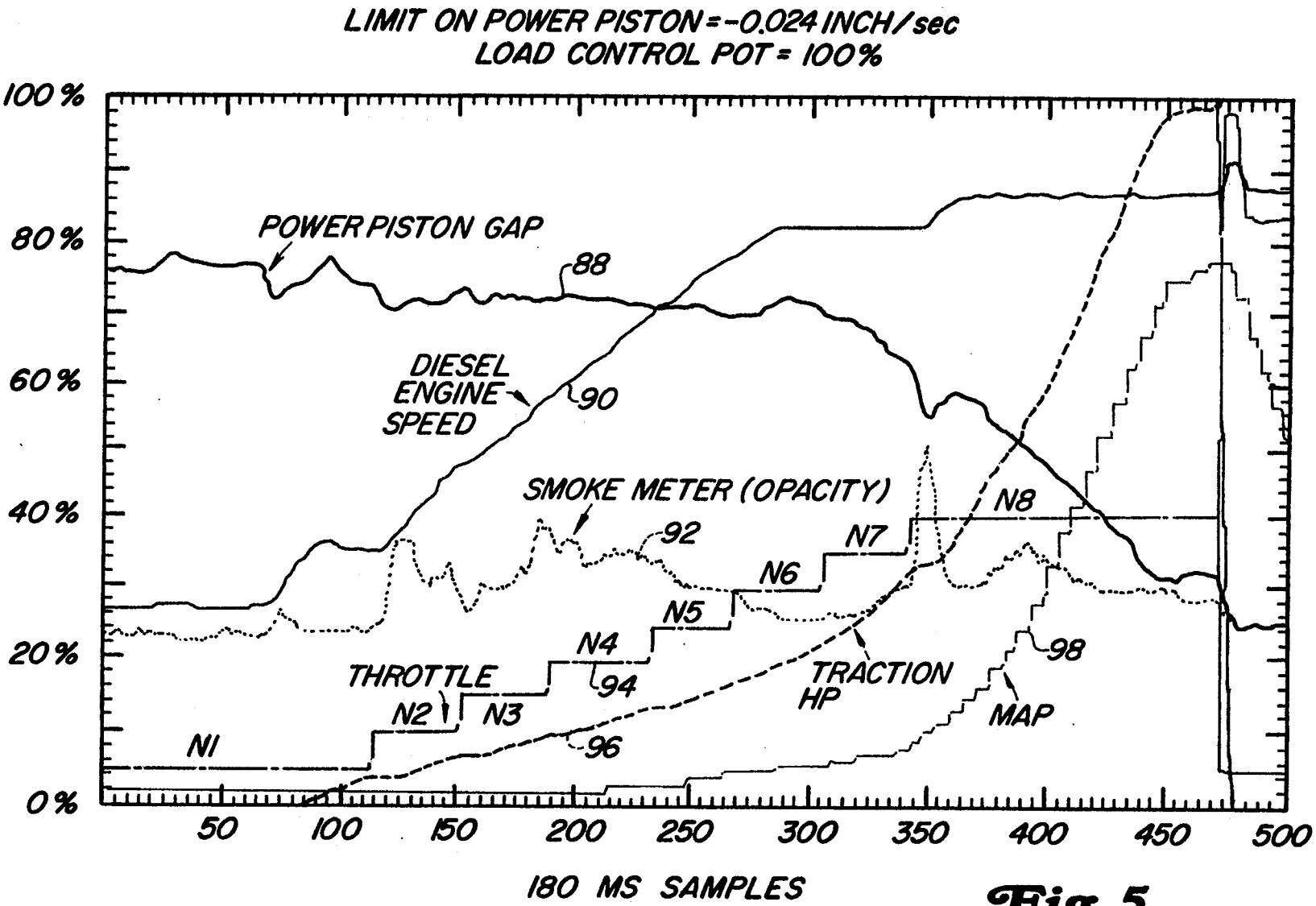
FIG. 5 is a graphic representation of test results of a locomotive employing the present method wherein the power piston gap velocity was limited to 0.024 inches/-second.

Referring now to FIGS. 3–5, the present method has been tested on various locomotives, and the results of those tests are indicated on the Figures, which depict the interrelationship of power piston velocity 88, diesel engine speed 90, smoke meter opacity values 92, throttle notch setting 94, traction horsepower 96 and manifold air pressure (MAP) 98 over time measured in 180 millisecond samples. FIG. 3 reflects locomotive operation at 5400 ft elevation, and FIGS. 4 and 5 reflect locomotive operation at 8,000 ft. It will be evident from an examination of FIGS. 3–5 that the basic curves of diesel engine speed 90, throttle notch setting 94, traction horsepower 96 and MAP 98 are relatively constant in all three examples. However, the power piston velocity 88 and smoke meter opacity value 92 are variable.

Referring now to FIG. 3, this example may be treated as a control situation, in that the power piston velocity 88 has not been limited in any way. It is evident that when the throttle notch setting reaches N8, at approximately the 375 millisecond sample, the smoke meter opacity reading approaches 92% which is definitely unacceptable, and indicates an instance of the type of engine overloading which the present method is designed to correct.

Referring now to FIG. 4, this example reflects locomotive operation when the power piston velocity limit is 0.204 inches per second. At this level, the control module 60 was allowed only to make minimal corrections in horsepower due to relatively large range of acceptable power piston gap velocities. The graph shows that upon reaching the throttle notch setting of N8, a step occurring at approximately the 300 millisecond time period, smoke meter opacity approaches 85%, which is still unacceptable.

Lastly, referring now to FIG. 5, locomotive performance is indicated when the power piston velocity limit is 0.024 inches per second. At throttle notch setting N8, the smoke meter opacity is approximately 48%. It will be seen that throttle notch setting N8 occurs slightly later than in FIG. 4, e.g. at 350 milliseconds; however the opacity value is significantly reduced from the performance of FIGS. 3 and 4, and is acceptable in the railroad industry.

Thus, a major advantage of the present method is that engine loading is compared against the power piston velocity, which is a parameter operating in a predictable relationship to engine loading. By employing the present method while loading, engine horsepower may be reduced automatically at a point which precedes the point of overfueling, and the subsequent production of transient smoke and fire.

While a particular embodiment of the method for limiting smoke and fire upon loading a diesel engine of the invention has been shown and described, it will be appreciated by those skilled in the art that changes and modifications may be made thereto without departing from the invention in its broader aspects and as set forth in the following claims.

What is claimed is:

1. A method for limiting smoke and fire upon loading a diesel engine having a power piston with a variable piston gap value for controlling fueling of the engine, the method comprising:

sensing the piston gap value on a cyclical basis;

computing the piston gap velocity;

comparing the computed piston gap velocity with a preset piston gap velocity range; and adjusting engine horsepower output upon the computing of an abnormal piston gap velocity reading.

2. The method as defined in claim 1 further including reducing engine horsepower upon the computing of a piston gap velocity beyond a specified range.

3. The method as defined in claim 2 further including reducing the rate of engine horsepower increase by an approximate factor of four upon the computing of an abnormal power piston gap velocity.

4. The method as defined in claim 1 further including computing the power piston gap velocity approximately every 60 milliseconds.

5. The method as defined in claim 1 wherein the specified range of power piston gap velocity is between approximately 0.008 and 0.252 inches/second.

6. The method as defined in claim 1 further including determining a desired change in engine horsepower over time upon computing the piston gap velocity reading within the preset range.

7. The method as defined in claim 6 further including determining the change in engine horsepower over time by monitoring total power being generated by the engine.

8. The method as defined in claim 7 wherein the monitoring of the total engine power includes monitoring factors selected from the group of engine speed, barometric pressure, manifold air pressure, ambient temperature, previous motor load settings, and diagnostic restrictions.

9. The method as defined in claim 6 further including disregarding the power piston gap velocity upon determining that the engine power is less than a minimum preset level.

10. The method as defined in claim 9 wherein the minimum preset level is approximately 200 horsepower.

11. A method for limiting smoke and fire upon loading a diesel engine having a power piston with a variable piston gap value for controlling fueling of the engine, the method comprising:

sensing the piston gap value on a cyclical basis;

computing a velocity of the change of the piston gap value using said sensed value;

comparing the computed piston gap velocity with a preset piston gap velocity range; and reducing engine horsepower output upon the computing of an abnormal piston gap velocity reading.

12. The method as defined in claim 11 further including determining the rate of engine horsepower change upon the computing of a piston gap velocity reading within the preset range.

13. The method as defined in claim 11 further including reducing a rate of engine power increase by a factor of four upon the computing of an abnormal power piston gap velocity.

14. The method as defined in claim 11 further including computing the power piston gap velocity approximately every 60 milliseconds.

15. A method for limiting smoke and fire upon loading a diesel engine having a power piston with a variable piston gap for controlling fueling of the engine, the method comprising:

sensing the piston gap value on a cyclical basis;

computing a piston gap velocity using said sensed value;

comparing the computed piston gap velocity with a preset piston gap velocity range; and determining the rate of engine horsepower change upon the computing of a piston gap velocity reading within the preset range.

16. The method as defined in claim 15 further including reducing engine horsepower output upon the computing of an abnormal piston gap velocity reading.

17. The method as defined in claim 16 further including reducing the rate of engine power increase by an approximate factor of four upon the computing of an abnormal power piston gap velocity.

* * * * *